US009506122B2

(12) United States Patent
Lonardi et al.

(10) Patent No.: US 9,506,122 B2
(45) Date of Patent: Nov. 29, 2016

(54) BLAST FURNACE INSTALLATION

(71) Applicant: PAUL WURTH S.A., Luxembourg (LU)

(72) Inventors: Emile Lonardi, Bascharage (LU); Dominique Rocchi, Joudreville (FR); Guy Thillen, Diekirch (LU); Lionel Hausemer, Sandweiler (LU); Christian De Gruiter, Fentange (LU); Jeff Vandivinit, Dalheim (LU)

(73) Assignee: PAUL WURTH S.A., Luxembourg (LU)

( * ) Notice: Subject to any disclaimer, the term of this patent is extended or adjusted under 35 U.S.C. 154(b) by 0 days.

(21) Appl. No.: 14/351,239

(22) PCT Filed: Oct. 5, 2012

(86) PCT No.: PCT/EP2012/069697

§ 371 (c)(1),
(2) Date: Apr. 11, 2014

(87) PCT Pub. No.: WO2013/053644

PCT Pub. Date: Apr. 18, 2013

(65) Prior Publication Data

US 2014/0246815 A1 Sep. 4, 2014

(30) Foreign Application Priority Data

Oct. 11, 2011 (LU) ..... 91 885

(51) Int. Cl.
*C21B 7/20* (2006.01)
*F27B 1/20* (2006.01)
(Continued)

(52) U.S. Cl.
CPC . *C21B 7/20* (2013.01); *F27B 1/20* (2013.01); *F27D 3/10* (2013.01); *F27D 99/0073* (2013.01)

(58) Field of Classification Search
CPC ..... C21B 7/20; C21B 5/06; F27B 1/20; F27D 3/10; F27D 99/0073
USPC ..... 266/199, 197, 184
See application file for complete search history.

(56) References Cited

U.S. PATENT DOCUMENTS 4,368,813 A 1/1983 Mailliet
5,299,900 A * 4/1994 Mailliet et al. ..... 414/206
(Continued)

OTHER PUBLICATIONS

International Preliminary Report on Patentability for corresponding application PCT/EP2012/069697 filed Oct. 5, 2012; Mail date Feb. 7, 2013.
(Continued)

*Primary Examiner* — Scott Kastler
*Assistant Examiner* — Michael Aboagye
(74) *Attorney, Agent, or Firm* — Cantor Colburn LLP

(57) ABSTRACT

A blast furnace installation includes a blast furnace and a chute transmission gearbox; the blast furnace having a top cone with a top cone ring arranged thereon for receiving a connection flange of the chute transmission gearbox. The connection flange is directly fixed onto the top cone ring by fixing means for establishing a firm connection between the top cone ring and the connection flange. According to an aspect of the present invention, the connection flange is fixed to the top cone ring in three separated fixation regions (30, 30', 30"), each fixation region including one or more fixing means. According to a further aspect of the present invention, the blast furnace installation also includes a flexible sealing element arranged around the perimeter of the connection between the top cone ring and the chute transmission gearbox.

7 Claims, 3 Drawing Sheets

(51) Int. Cl.
*F27D 3/10* (2006.01)
*F27D 99/00* (2010.01)

(56) References Cited

U.S. PATENT DOCUMENTS 5,738,822 A * 4/1998 Lonardi et al. ..... 266/199
6,004,090 A 12/1999 Axelsson
6,213,275 B1 4/2001 Lonardi et al.
6,338,815 B1 * 1/2002 Seng ..... 266/199
6,540,958 B1 * 4/2003 Heinrich et al. ..... 266/199
6,685,878 B1 2/2004 Overlander et al.
2004/0224275 A1 11/2004 Lonardi et al.
2005/0063804 A1 3/2005 Gorza et al.

OTHER PUBLICATIONS

International Search Report for corresponding application PCT/EP2012/069697 filed Oct. 5, 2012; Mail date Jan. 14, 2013.

* cited by examiner

BLAST FURNACE INSTALLATION

TECHNICAL FIELD

The present invention generally relates to a blast furnace installation, in particular comprising blast furnace and a chute transmission gearbox arranged thereon. More particularly, the invention concerns the connection between the chute transmission gearbox and the blast furnace. The present invention further relates to a method for installing a chute transmission gearbox on a blast furnace.

BACKGROUND ART

Blast furnaces of the bell less Top® design comprise a chute transmission gearbox between the top cone of the blast furnace and the material charging hoppers. Such a chute transmission gearbox comprises ball bearings for the rotation of the associated rotary chute, which is used to evenly distribute charge material into the blast furnace. The correct installation of the chute transmission gearbox on the top of the blast furnace is of particular importance. An incorrect installation may have devastating consequences on the correct functioning of the ball bearings, and consequently of the chute transmission gearbox. Indeed, the seat receiving the chute transmission gearbox must be precision engineered and must satisfy rather strict tolerances regarding flatness.

Generally, the top cone of the blast furnace is provided with a top cone ring for receiving a connection flange of the chute transmission gearbox thereon. Both the top cone ring and the connection flange must be machined so that they fit together perfectly. In order to further avoid any gas from escaping between the top cone ring and the chute transmission gearbox, a sealing compound is applied on the top cone ring before installation. In view of the strict tolerances that have to be respected, it is generally necessary to adapt the top cone ring during erection or revamping of the blast furnace. Such on-site adaptation of the top cone ring is rather time-consuming and thus expensive. In some circumstances it may furthermore be particularly difficult to meet the necessary tolerances, thus with the risk of installing the chute transmission gearbox without respecting the necessary tolerances and therefore endangering the correct functioning of the rotary chute.

BRIEF SUMMARY

A blast furnace installation is provided with an improved means for adjusting and aligning the chute transmission gearbox on a blast furnace. Also provided is a method for installing a chute transmission gearbox on a blast furnace, wherein adjusting and aligning the chute transmission gearbox is improved.

A blast furnace installation comprises a blast furnace and a chute transmission gearbox; the blast furnace comprising a top cone with a top cone ring arranged thereon for receiving a connection flange of the chute transmission gearbox. The connection flange is directly fixed onto the top cone ring by fixing means for establishing a firm connection between the top cone ring and the connection flange. According to an aspect of the present invention, the connection flange is fixed to the top cone ring in three separated fixation regions, each fixation region comprising one or more fixing means. According to a further aspect of the present invention, the blast furnace installation also comprises a flexible sealing element arranged around the perimeter of the connection between the top cone ring and the chute transmission gearbox.

In essence, the chute transmission gearbox is carried by the top cone ring, without paying particular attention to how well the connection flange sits on the top cone ring. Irrespective of the presence of gaps between the connection flange and the top cone ring, the fixing means in the fixation regions are used to establish a firm connection between the top cone ring and the connection flange. In other words, small gaps may exist between top cone ring and the connection flange of the chute transmission gearbox. According to the present invention, such small gaps are not problematic and a perfect fit between connection flange and top cone ring is not necessary.

In prior art installations, however, any gaps between the connection flange of the chute transmission gearbox and the top cone ring constitute a major problem. As the chute transmission gearbox is connected to the top cone ring around essentially the whole of its perimeter, in the region of the gap, the chute transmission gearbox may be deformed by the fixing means. Such deformation is of course detrimental to the correct functioning of the ball bearings and thus of the rotary chute. Furthermore, as the sealing is achieved by means of a sealing compound between the two contact surfaces, a gap therein allows gas to escape through the gap. Thus it is, in prior art installations, essential to adapt the top cone ring and/or the connection flange on site so as to avoid such gaps.

According to the present invention, on the other hand, the fixation takes place in three fixation regions and gaps are allowed to exist. Consequently, the only intervention needed is to align the chute transmission gearbox horizontally to meet the strict installation tolerances. Instead of machining the top cone ring and/or the connection flange on site so as to eliminate such gaps, the present invention indeed suggests to fix the connection flange to the top cone ring without necessitating a perfect fit between the connection flange and the top cone ring. Thus, it is considerably easier, faster and cheaper to install the chute transmission gearbox. The inventors have found that fixing the chute transmission gearbox in exactly three fixation regions only, leads to fewer deformations in the chute transmission gearbox, which in turn leads to fewer stresses on the ball bearings of the chute transmission gearbox. A correct installation of the chute transmission gearbox is therefore achieved more easily and the correct functioning of the gearbox can be guaranteed. The lifetime of the gearbox may also be prolonged.

Furthermore, the flexible sealing element arranged around the perimeter of the connection between the top cone ring and the chute transmission gearbox prevents any gas from escaping through any possible gaps between the connection flange and the top cone ring. Such a flexible sealing element applied on the outside after correct placement of the chute transmission gearbox allows replacing the previously used, rather delicate sealing method of applying a sealing compound on the top cone ring before positioning of the chute transmission gearbox.

Advantageously, the collective space covered by the fixation regions does not exceed 180° of the angular surface of the top cone ring. By limiting the number and size of the fixation regions, the stresses and deformations that the chute transmission gearbox may be exposed to is greatly reduced. Furthermore, the fixation regions are preferably arranged equidistantly from one another.

The fixing means in the fixation regions may comprise a bolt and nut connection between the top cone ring and the connection flange. Each fixation region may comprise between 5 and 30 fixing means.

According to a preferred embodiment, shim plates may be provided between the top cone ring and the connection flange. Such shim plates are preferably primarily used in the fixation regions for carrying out the horizontal alignment of the chute transmission gearbox on the top cone ring. In addition, shim plates may be used outside of the fixation regions to reduce the gaps between the chute transmission gearbox and the top cone ring. Due to the presence of the flexible sealing element, the shim plates need not fill the gaps in a gastight manner. Thus, installation of the shim plates can be effected quickly and efficiently.

Advantageously, the flexible sealing element comprises a flexible sheet arranged between a first connecting portion and a second connecting portion, the first connecting portion being welded to one of the top cone ring and the connection flange.

Before and during the installation process, a bracketing device is preferably provided between the first and second connecting portions for connecting the second connecting portion to the first connecting portion. The flexible sheet may be pre-stressed; in which case, the bracketing device maintains the flexible sheet in its pre-stressed state.

After the installation process, the second connecting portion is preferably welded to the other one of the top cone ring and the connection flange.

Thus, the flexible sealing element may initially be provided on the top cone ring. In this case, the first connecting portion is initially welded to the top cone ring and, after installation, the second connecting portion is welded to the connection flange. Preferably, however, the flexible sealing element is initially provided on the connection flange, wherein the first connecting portion is initially welded to the connection flange and, after installation, the second connecting portion is welded to the top cone ring.

The present invention also relates to a method for installing a chute transmission gearbox on a top cone of a blast furnace, the method comprising the steps of:

welding a top cone ring on the top cone;

placing the chute transmission gearbox on the top cone ring;

adjusting and horizontally aligning the chute transmission gearbox on the top cone ring in three fixation regions;

connecting a flexible sealing element around the perimeter of the connection between the top cone ring and the chute transmission gearbox; and fixing the chute transmission gearbox to the top cone ring in of the three fixation regions.

The present method allows an installation without worrying about any gaps that may exist between the chute transmission gearbox and the top cone ring. Indeed, as the flexible sealing element ensures that the connection is gastight, there is no longer any need for the chute transmission gearbox to sit exactly on the top cone ring along the whole of its circumference. The fixing of the chute transmission gearbox to the top cone ring is limited to the three fixation regions without requiring a perfect fit of the connection flange on the top cone ring. This leads to an easier, quicker and cheaper installation of the chute transmission gearbox.

The adjusting and horizontally aligning of the chute transmission gearbox on the top cone ring in the three fixation regions may comprise the additional step of providing shim plates between the top cone ring and the connection flange.

It should be noted that the step of connecting the flexible sealing element may be carried out before or after the step of fixing the chute transmission gearbox to the top cone ring, both being within the scope of the present invention.

Preferably, before installation, a flexible sealing element is provided, the flexible sealing element comprising a flexible sheet arranged between a first connecting portion and a second connecting portion, the first connecting portion being welded to one of the top cone ring and the connection flange. Furthermore, a bracketing device is then provided between the first and second connecting portions for connecting the second connecting portion to the first connecting portion. The flexible sealing element can thus be mounted before installation of the chute transmission gearbox, but due to the bracketing device, the flexible sealing element remains tucked away out of the connection regions.

Advantageously, the step of connecting the flexible sealing element comprises removing the bracketing device and welding the second connecting portion to the other one of the top cone ring and the connection flange. Once the chute transmission gearbox has been correctly aligned on the top cone ring, the bracketing device can be removed such that the flexible sealing element can extend from the top cone ring to the connection flange. The subsequent welding of the second connecting portion to the other one of the top cone ring and the connection flange creates a gastight seal preventing any gas from escaping through the gap between the top cone ring and the connection flange of the chute transmission gearbox.

The flexible sealing element replaces the rather more delicate sealing, which comprises applying a sealing compound between the top cone ring and the connection flange. It should be noted that the flexible sealing element as disclosed herein may be used irrespective of how the connection flange rests on the top cone ring. In other words, the present sealing arrangement may also be used in connection with any other, possibly state of the art, connection between chute transmission gearbox and top cone ring.

A protection cord is preferably placed between the first and second connecting portions before welding and removed after welding. Such a protection cord, which preferably comprises ceramic material, protects the flexible sheet from any weld spatter during welding, thus preventing the flexible sealing element from being damaged during the welding process.

BRIEF DESCRIPTION OF THE DRAWINGS

Preferred embodiments of the invention will now be described, by way of example, with reference to the accompanying drawings, in which.

DETAILED DESCRIPTION

Figure 1:
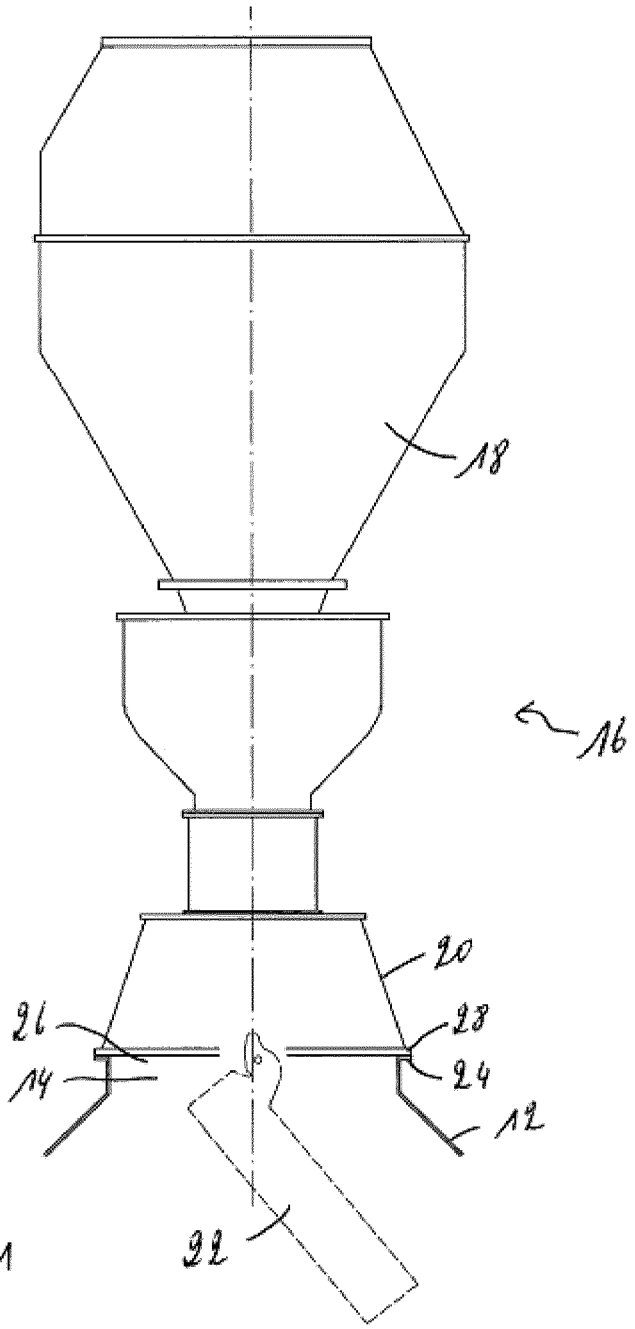
FIG. 1 is a schematic view of a charging installation mounted on a top cone of a blast furnace.

A blast furnace installation comprises a blast furnace with a furnace shaft, which has, in an upper region, a top cone 12 with a central opening 14 for feeding charge material into the furnace shaft. A charging installation 16 is arranged centrally above the furnace shaft for feeding charge material into the blast furnace. Such a charging installation 16 is typically of the bell less Top® type and comprises one or more material hoppers 18 and a chute transmission gearbox 20 carrying a rotary chute 22. The chute transmission gearbox 20 comprises a central passage for allowing for the charge material to flow from the hoppers 18 arranged above the chute transmission gearbox 20 through the central passage onto the rotary chute 22. The latter rotates so as to evenly distribute the charge material in the furnace.

For the rotation of the rotary chute 22, the chute transmission gearbox 20 is provided with ball bearings (not shown). The fixation of the chute transmission gearbox 20 on the top of the top cone 12 must be effected in a precise manner. A top cone ring 24, which is configured to serve as a seat for the chute transmission gearbox 20, is welded to the top of the top cone 12. Such a top cone ring 24 has an opening 26 in alignment with the opening 14 of the top cone 12. The chute transmission gearbox 20 comprises on its lower portion a connection flange 28, which is designed to rest on the top cone ring 24.

Figure 2:
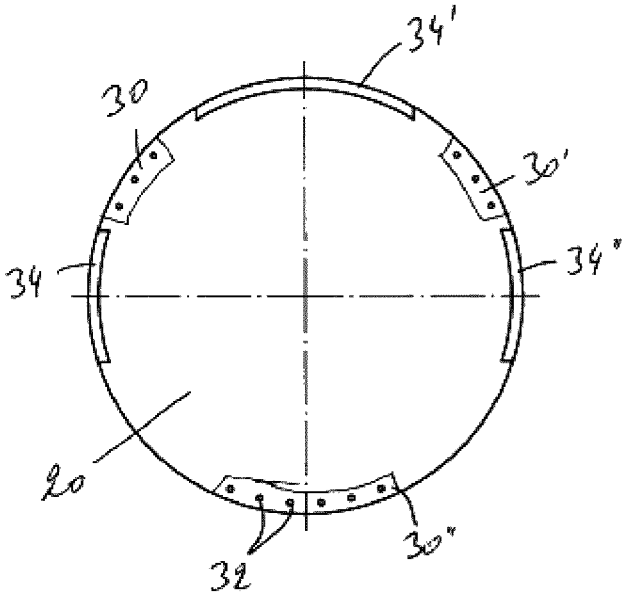
FIG. 2 is a horizontal cross-section through the chute transmission gearbox according to the present invention.

The present invention is more particularly concerned with the connection between the connection flange 28 and the top cone ring 24. This connection can be more closely described by referring to FIG. 2, which shows a horizontal cross-section through the chute transmission gearbox 20 and FIGS. 3 and 4, which show an enlarged view of a portion of the connection.

The chute transmission gearbox 20 comprises three fixation regions 30, 30', 30", each having a number of fixing means 32. The fixing means 32, preferably in the form of a bolt and nut connection, creates a firm connection between the top cone ring 24 and the connection flange 28 so as to securely fix the chute transmission gearbox 20 to the top cone 12 of the blast furnace. In the regions between the fixation regions 30, the chute transmission gearbox 20 may comprise access doors 34, 34', 34".

According to the present invention, the fixation of the chute transmission gearbox 20 to the top cone ring 24 takes place in the three fixation regions 30, 30', 30" only. Although the horizontal alignment of the chute transmission gearbox 20 still needs to meet strict installation tolerances, there no longer needs to be a perfect fit between the connection flange 28 and the top cone ring 24. In the fixation regions 30, 30', 30" and/or in the regions outside of the fixation regions 30, 30', 30", small gaps may exist between top cone ring 24 and the connection flange 28. Unlike in prior art installations, where the top cone ring 24 and/or the connection flange 28 must be machined to eliminate such gaps, the present invention allows the gaps to remain. The alignment of the chute transmission gearbox 20 on the top cone ring 24 is simplified by the fact that the necessary tolerances can be met without necessarily having to create a perfect fit. In the three fixation regions 30, 30', 30", the top cone ring 24 is horizontally aligned on the connection flange 28, possibly with the use of shim plates (not shown) in order to meet the strict installation tolerances without however worrying about achieving strict gas tightness.

Any gaps that may exist do not constitute a problem. Indeed, as the present invention introduces a flexible sealing element, a gastight connection is not necessary between the surfaces of the connection flange 28 and the top cone ring 24.

Figure 3:
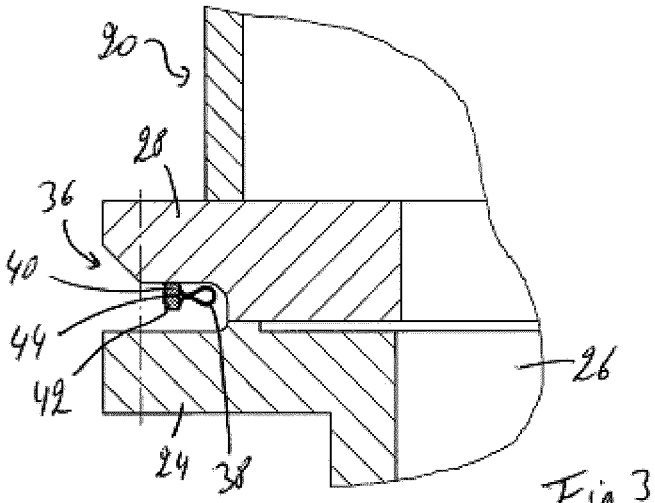
FIG. 3 is an enlarged cross-section view through a portion of the connection between connection flange and top cone ring during one stage of the installation.
Figure 4:
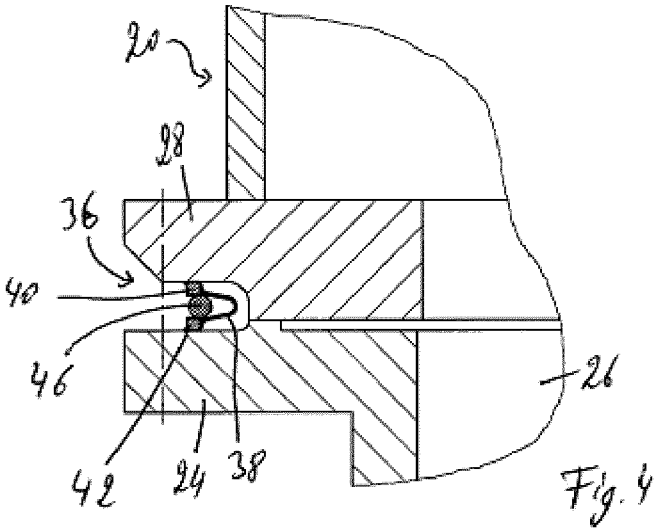
FIG. 4 is an enlarged cross-section view through a portion of the connection between connection flange and top cone ring during another stage of the installation.

The flexible sealing element can be more closely described by referring to FIGS. 3 and 4. The flexible sealing element 36 arranged around the perimeter of the connection between the top cone ring 24 and the chute transmission gearbox 20 prevents any gas from escaping through any possible gaps between the connection flange 28 and the top cone ring 24. Such a flexible sealing element 36 applied on the outside after correct placement of the chute transmission gearbox 20 allows replacing the previously used, rather delicate sealing method of applying a sealing compound on the top cone ring 24 before positioning of the chute transmission gearbox 20.

The flexible sealing element 36 may, as shown in FIGS. 3 and 4, comprise a flexible sheet 38, which is preferably made from metal, arranged between a first connecting portion 40 and a second connecting portion 42. The first connection portion 40 is welded to the connection flange 28 of the chute transmission gearbox 30. As shown in FIG. 3, the second connecting portion 42 is maintained against the first connection portion 40 by means of a bracketing device 44. This bracketing device 44 keeps the first and second connecting portions 40, 42 together, which is of particular importance during the alignment of the chute transmission gearbox 20. Indeed, while the chute transmission gearbox 20 is being aligned horizontally so as to meet the strict mounting tolerances, the second connecting portion 42 is kept out of the way, i.e. it is kept away from the contact surfaces between the connection flange 28 and the top cone ring 24. In particular, as the flexible sheet 38 is advantageously pre-stressed, the bracketing device 44 maintains the flexible sheet 38 in its pre-stressed state and out of the contact zones of the fixation regions 30, 30', 30".

Once the chute transmission gearbox 20 has been correctly adjusted and the connection flange 28 is in contact with the top cone ring 24, possibly via shim plates inserted in any gaps, the bracketing device 44 can be removed in order to allow the second connecting portion 42 to be connected to the top cone ring 24.

As shown in FIG. 4, a protection cord 46, preferably comprising ceramic material, is inserted between the gap between the first and second connecting portions 40, 42 before the second connecting portion 42 is welded to the top cone ring 24. This protection cord 46 protects the flexible sheet 38 from any weld spatter during welding, thus preventing the flexible sealing element 36 from being damaged during the welding process. Once the second connecting portion 42 is welded to the top cone ring 24, the protection cord 46 can be removed.

The welding of the second connecting portion 42 to the top cone ring 24 creates a gastight seal preventing any gas from escaping through the gaps between the top cone ring 24 and the connection flange 28 of the chute transmission gearbox 20.

The invention claimed is:

1. A blast furnace installation comprising:

a blast furnace and a chute transmission gearbox;

said blast furnace comprising a top cone with a top cone ring arranged thereon structured for receiving a connection flange of said chute transmission gearbox, said connection flange is directly fixed onto said top cone ring by a fixing component configured for establishing a firm and direct connection between said top cone ring and said connection flange;

wherein said connection flange is fixed to said top cone ring in three separated, circumferentially distributed fixation regions, each fixation region comprising one or more fixing components;

wherein the blast furnace installation further comprises a flexible sealing element for ensuring a gas-tight connection between said top cone ring and said connection flange, the flexible sealing element is arranged around the outside of the perimeter of the connection between said top cone ring and said connection flange; and said flexible sealing element comprising a flexible sheet arranged between a first connecting portion and a second connecting portion, said first connecting portion being welded to one of said top cone ring and said connection flange, and said second connecting portion is welded to the other one of said top cone ring and said connection flange.

2. The blast furnace installation according to claim 1, wherein a collective space covered by said fixation regions does not exceed 180° of an angular surface of said top cone ring.

3. The blast furnace installation according to claim 1, wherein said fixation regions are arranged essentially equidistantly from one another.

4. The blast furnace installation according to claim 1, wherein said fixing component in said fixation regions comprise a bolt and nut connection between said top cone ring and said connection flange.

5. The blast furnace installation according to claim 4, wherein each fixation region comprises between 5 and 30 fixing components.

6. The blast furnace installation according to claim 1, wherein shim plates are provided between said top cone ring and said connection flange.

7. The blast furnace installation according to claim 1, wherein the top cone ring and the connection flange are in direct contact with each other.

* * * * *